US005881844A

United States Patent [19]

Thompson et al.

[11] Patent Number: 5,881,844

[45] Date of Patent: Mar. 16, 1999

[54] SECONDARY POSITIONING SYSTEM FOR ELEVATOR CAR DOORS

[75] Inventors: Garnett Thompson, Bloomfield; Richard N. Fargo, Plainville, both of Conn.; David K. Gentzler, Tucson, Ariz.; Bennie Murah, Farmington, Conn.; James P. Towey, Jr., Bristol, Conn.; Michael J. Tracey, Cromwell, Conn.

[73] Assignee: Otis Elevator Company, Farmington, Conn.

[21] Appl. No.: 746,278

[22] Filed: Nov. 7, 1996

[51] Int. Cl.[6] ..... B66B 13/14

[52] U.S. Cl. ..... 187/336; 187/316

[58] Field of Search ..... 187/287, 316, 187/3; 49/120

[56] References Cited

U.S. PATENT DOCUMENTS

| | | | |
|---|---|---|---|
| 4,674,604 | 6/1987 | Williams . | |
| 5,250,765 | 10/1993 | Mizuno et al. . | |
| 5,495,918 | 3/1996 | Peruggi et al. | 187/316 |
| 5,509,504 | 4/1996 | McHugh et al. | 187/316 |

FOREIGN PATENT DOCUMENTS

| | | |
|---|---|---|
| 0351490 | 1/1990 | European Pat. Off. . |
| 2177792 | 1/1987 | United Kingdom . |
| 2201811 | 9/1988 | United Kingdom . |

*Primary Examiner*—Karen M. Young
*Assistant Examiner*—Gregory A. Morse

[57] ABSTRACT

A secondary positioning system for elevator car doors includes three sensors positioned in register with a plurality of openings formed within a door hanger. The unique spacing between the sensors in combination with unique spacing between each of the openings within the door hanger, allows determination of fully closed, fully opened, and intermediate positions and direction of elevator car doors.

10 Claims, 4 Drawing Sheets

SECONDARY POSITIONING SYSTEM FOR ELEVATOR CAR DOORS

CROSS-REFERENCE TO RELATED APPLICATIONS

This application is related to commonly-owned co-pending applications filed on the same day herewith having Ser. Nos. 08/746,277, now abandoned, and 08/746,281.

1. Technical Field

The present invention relates to elevator car door systems and, more particularly, to positioning systems therefor.

2. Background of the Invention

In conventional elevator systems, elevator car doors are selectively opened and closed by mechanical assemblies driven by rotary DC motors. A single positioning system is typically used to determine the position and speed of the doors. The positioning system is usually an open loop system with no velocity feedback and comprises a plurality of limit switches. The rotary DC motors typically do not require more sophisticated positioning systems (that is, velocity and/or position sensing systems) because the velocity of the elevator car doors will not exceed a preset, constant value determined by the applied voltage and electrical characteristics of the particular motor.

Some modern elevator car door systems include a rotary AC motor with a closed loop velocity control system. Such systems include an encoder coupled to the rotary motor for determining the velocity and position of the elevator car doors. Such a positioning system is still acceptable for AC motor driven systems, because a close correlation exists between the frequency of voltage or current applied to the motor and the speed of the elevator car doors. Since there is a direct relationship between the electrical speed of the motor and the mechanical speed of the elevator car doors, the elevator car doors will not exceed a certain speed.

In elevator car door systems that use linear motors to selectively open and close elevator car doors, a relatively large magnetic air gap between a motor primary and a motor secondary exists that results in a "slip", i.e. a difference between the frequency of voltage or current applied to the motor and the speed of the elevator car doors. Therefore, the speed of the elevator car doors cannot be determined from knowing the frequency of the voltage or current applied. Thus, a positioning system is necessary to avoid overspeeding motion of the elevator car doors.

However, the conventional positioning systems described above are not sufficient for linear motors. If the velocity feedback was lost or interrupted, it would not be possible to differentiate between a failed positioning system and stalled doors. If the controller believed that the doors were stalled as a result of blockage, it would increase the force to the doors to overcome the stall. However, if the feedback was actually lost as a result of the positioning system failure, any excessive force applied to overcome the assumed stall may result in door speed that is greater than desired.

DISCLOSURE OF THE INVENTION

It is an object of the present invention to provide a reliable positioning system for elevator car doors driven by linear induction motors.

According to the present invention, an elevator car door system for selectively opening and closing elevator car doors in an elevator system includes a secondary positioning system in addition to a primary positioning system to ensure proper operation of the elevator car doors even during failure of the primary positioning system. The secondary positioning system comprises a sensor housing disposed on a header bracket with three sensors protruding from the housing and facing a plurality of openings formed within a door hanger. The three sensors housed in a single housing, in combination with a unique pattern of openings within the door hanger and the use of quadrature logic, allow detection of a fully closed position, a fully opened position, and the intermediate positions and direction of the elevator car doors.

One advantage of the present invention is that the secondary positioning system recalibrates the primary positioning system.

Another advantage of the present invention is that the secondary positioning system provides, independent of the primary system, verification that the doors are fully closed or fully opened.

The foregoing and other advantages of the present invention become more apparent in light of the following detailed description of the exemplary embodiments thereof, as illustrated in the accompanying drawings.

BEST MODE FOR CARRYING OUT THE INVENTION

Figure 1:
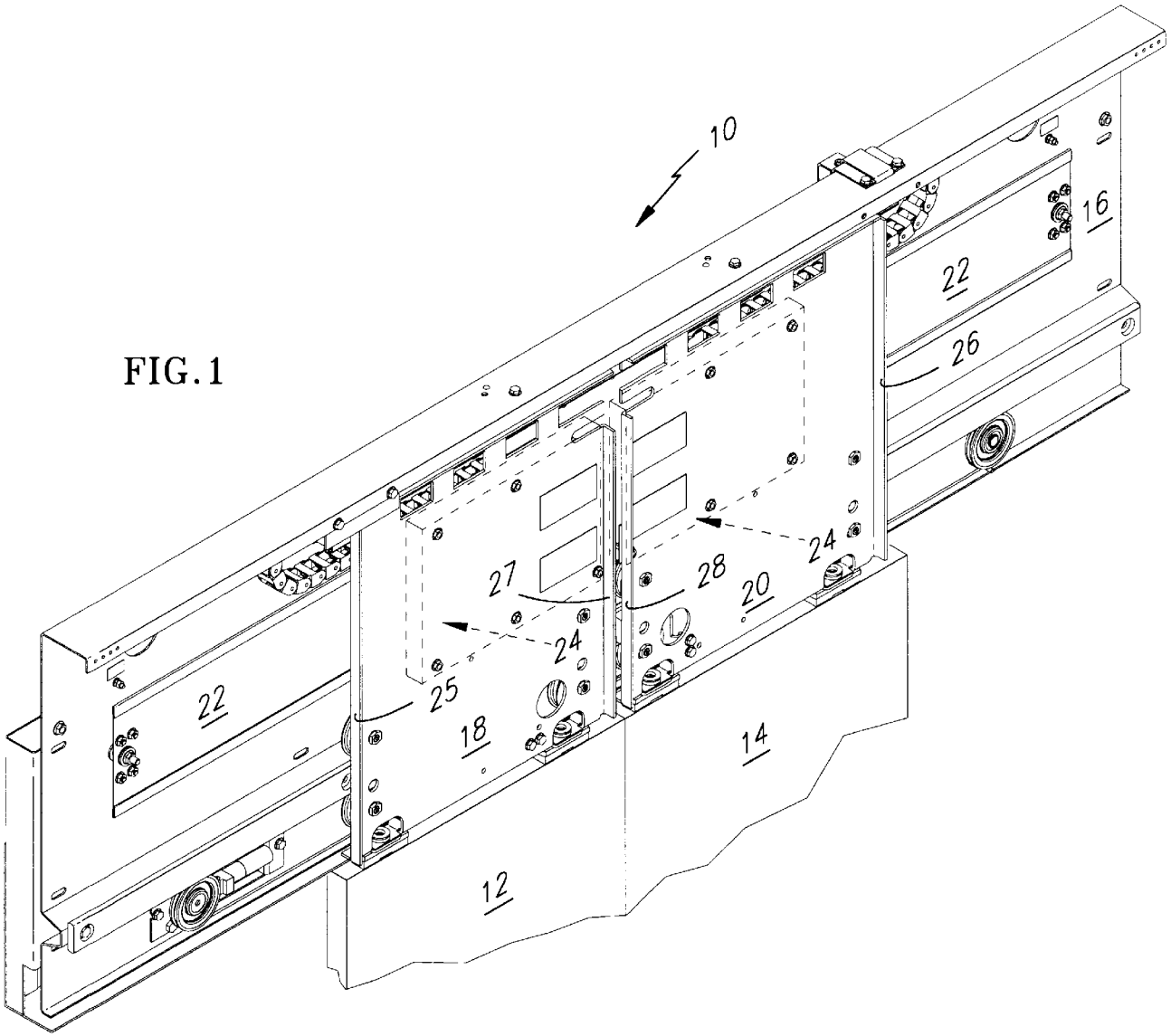
FIG. 1 is a schematic, perspective view of an elevator door system.

Referring to FIG. 1, an elevator car door system 10 for selectively opening and closing elevator car doors 12, 14 includes a header bracket 16 which supports a first and a second door hangers 18, 20 that have the first and second elevator car doors 12, 14, suspended therefrom, respectively. A linear motor driving the elevator car doors 12, 14 includes a motor secondary 22 attached to the header bracket 16 and a pair of motor primaries 24, each attaching onto the door hangers 18, 20. Each door hanger 18, 20 is bound by an outside edge 25, 26 and an inside edge 27, 28, respectively.

Figure 2:
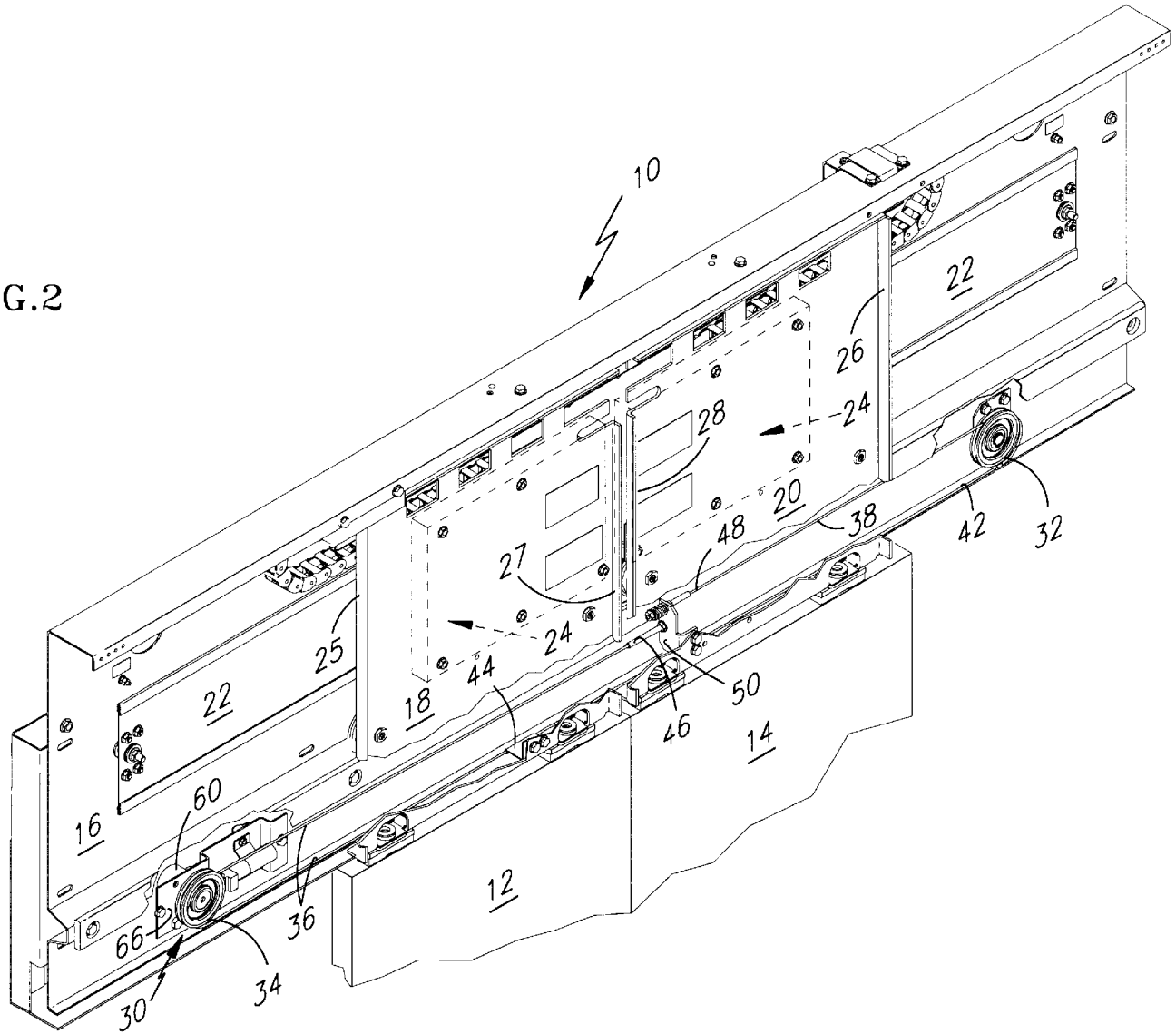
FIG. 2 is a cut-away, schematic, perspective view of the door system of FIG. 1, including a primary positioning system.

Referring to FIG. 2, a primary positioning and synchronization system 30 includes an idler pulley 32 secured to the header bracket 16 on one side thereof and an encoder pulley 34 secured to the header bracket on the opposite side thereof. A relating cable 36 extends over both pulleys 32, 34 to form a closed loop with an upper loop portion 38 and a lower loop portion 42. The lower portion 42 of the relating cable 36 is continuous and is fixedly attached onto the first door hanger 18 by means of a first hitch 44. The upper portion 38 of the relating cable 36 includes two ends 46,48 of the cable with each end attaching onto the second door hanger 20 by means of a second hitch 50. The attachment of the ends 46,48 of the cable 36 to the second hitch 50 is adjustable to accommodate periodic calibration of tension within the cable.

The pulleys 32,34 include high friction polymer grooves that the relating cable 36 comes into contact with. The most effective type of high friction polymer for this invention is urethane.

The primary positioning and synchronization system 30 also includes a rotary encoder 60 coupled to the encoder pulley 34, which is fixedly secured onto the header bracket 16 by means of a mounting flange 66.

Figure 3:
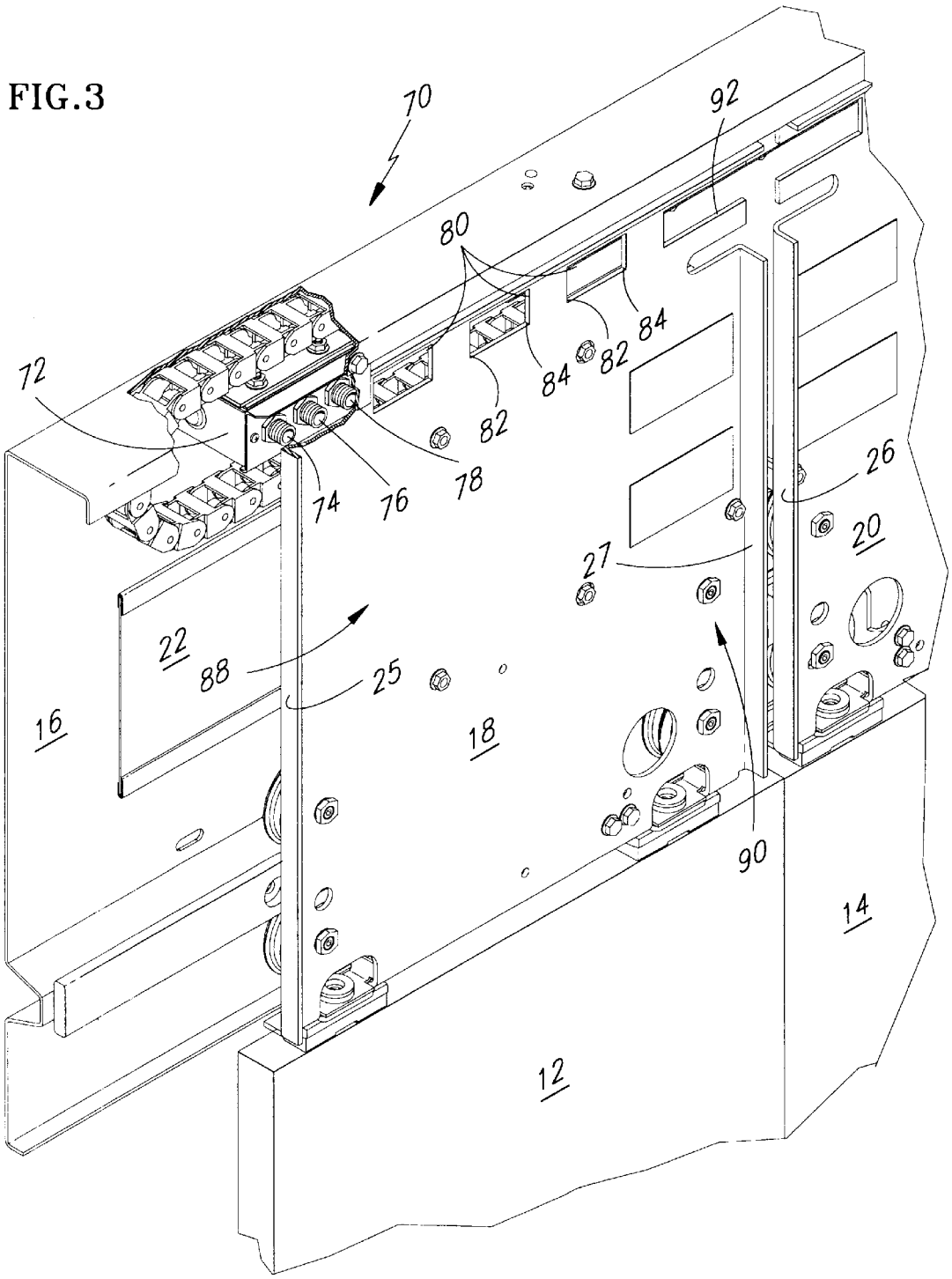
FIG. 3 is an enlarged, cut-away, schematic, perspective view of the door system of FIG. 2, including a secondary positioning system, according to the present invention.

Referring to FIG. 3, a secondary positioning system 70 includes a sensor housing 72 fixedly attached to a header bracket 16 with first, second and third sensors 74, 76, 78 protruding therefrom and facing the door hanger 18. Each sensor includes a center and a diameter.

The door hanger 18 includes a plurality of openings 80 formed therein which are in register with the sensors 74, 76, 78. Each opening includes a first and a second vertical edge 82, 84. The distance from the first vertical edge 82 of one opening to the first vertical edge 82 of the next opening is set to be 360° or a full phase apart. The length of each opening 80 or the distance between the first vertical edge 82 to the second vertical edge 84 of each opening is approximately 180°, or half the phase, plus a compensating adjustment. The length of the solid metal hanger between the openings or the distance from the second vertical edge 84 of one opening to the first vertical edge 82 of the next opening is approximately 180° minus the compensating adjustment. The compensating adjustment approximately equals the diameter of each sensor. The adjustment is necessary because sensors change state from high to low or vice versa when only partially engaged with the metal rather than when a center of the sensor crosses any of the vertical edges of the openings.

The first opening 80 is spaced away from the outer vertical edge 25 of the door hanger 18 to define a fully closed door region 88. The fully closed door region 88 is wide enough to fit three sensors 74, 76, 78 between the outer vertical edge 25 of the door hanger 18 and the first vertical edge 82 of the first opening 80. A fully open door region 90 is defined to be adjacent to the inner edge 27 of the door hanger 18. The fully open door region 90 includes a notch 92 extending the width of the three sensors 74, 76, 78.

The first and the second sensors 74, 76 are spaced 120° apart center-to-center. The second and third sensors 74, 76 are also spaced 120° apart center-to-center.

In operation, the linear motor drives the elevator car doors 12, 14 into open and closed positions. As the elevator car doors 12, 14 travel in opposite directions, the primary positioning and synchronization system 30 ensures that both doors travel simultaneously at the same speed. The relating cable 36 pulls both doors simultaneously as the doors are opened or closed. Since there is essentially no slippage between the urethane groove of the pulleys 32,34 and the relating cable 36, the encoder 60 readings are accurate. As the doors 12, 14 travel between the open and closed positions, the rotary encoder 60 generates incremental pulses which indicate changes in door position and direction. The encoder 60 sends signals to the controller box (not shown) which interprets the position and direction data to derive the speed of the doors.

Figure 4:
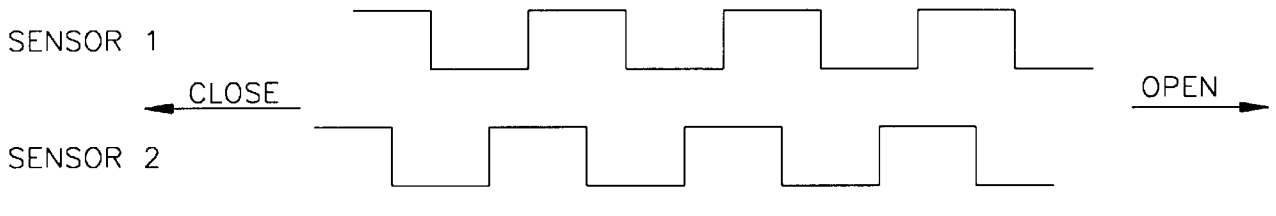
FIG. 4 is a signal output of a first and a second sensors of the secondary positioning system of FIG. 3.

The secondary positioning system 70 verifies data and information obtained from the primary positioning system 30. The secondary positioning system indicates a fully opened, fully closed, or intermediate position and direction of travel of the doors 12, 14. The first and second sensors 72, 74 provide signals used for determining the intermediate position and direction of travel of the doors. The signals from the first and second sensors 72, 74 are sent to the door controller and analyzed in software. A known quadrature logic method is used to determine the direction and intermediate position of the doors. Referring to FIG. 4, a high state represents that the sensors detect metal, a low state represents that the sensors detect an opening. For example, using quadrature logic for tracking the door position and its direction, if the first sensor 74 is high and the second sensor 76 changes from high to low, one count opening is registered.

Figure 5:
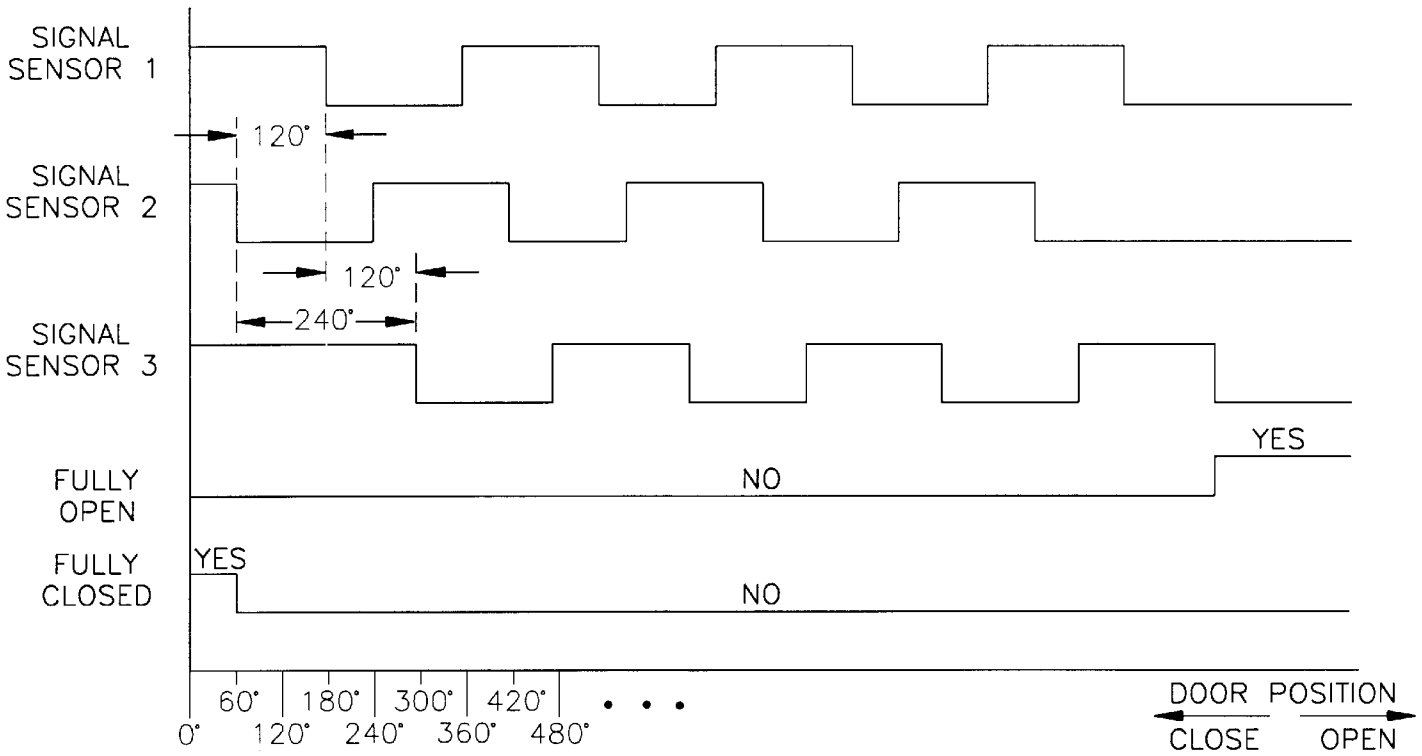
FIG. 5 is a signal output of the first, second, and third sensors of the secondary positioning system of FIG. 3.

Referring to FIG. 5, the third sensor 78 is used in combination with the first and second sensors 74, 76 to establish the fully closed and fully opened positions of the elevator car doors. The logic used is that if the first sensor is high and the second sensor is high and the third sensor is high, the doors are fully closed; else if the first sensor is low and the second sensor is low and third sensor is low, the doors are fully opened; else the doors are neither fully opened or fully closed and the quadrature logic is used to determine the intermediate position and direction of the doors from the signals of the first and second sensors. The spacing between the sensors and between the openings is chosen so that only when the doors are fully closed all three sensors detect metal, showing a high state, and are facing the fully closed region 88; and when the doors are fully opened, all three sensors detect an opening, showing a low state, and are facing the notch 92 of the fully opened region 90. At all intermediate positions of the doors, the three sensors are never in the same state.

The present invention of using three discrete sensors housed in a single sensor housing to determine an intermediate position and direction of elevator car doors, as well as a fully opened and a fully closed status of the doors, provides a simple and relatively inexpensive method for verifying data and information of the primary positioning system. One of the unique features of the present invention is the use of only three sensors and a unique coding scheme to determine fully opened, closed, and intermediate positions of the elevator car doors. Additionally, since the second positioning system is not affected by cable slippage it is utilized to recalibrate the primary positioning system.

Although the best mode embodiment of the present invention describes three sensors spaced 120° apart, the spacing between sensors can range from greater than 90° to less than 180°. The 120° spacing was chosen to provide the greatest tolerance for the sensors in order to prevent having all three sensors indicating the same state between the terminal positions of the elevator car doors, i.e. fully opened or fully closed. The spacing between each of the plurality of openings also can be varied, as long as there is no occurrence of all three sensors indicating the same state between the terminal positions of the elevator car doors.

FIG. 1 and 2 depict both door hangers having openings. Only one door hanger is required to have the openings for the secondary positioning system to operate properly because the best mode embodiment of the present invention includes a first positioning and synchronization system to ensure simultaneous movement of both doors. However, for ease of manufacturing, both door hangers are shown to have openings. Also, the number of openings can vary depending on a particular application and door size. The sensors can be placed on either door hanger. Also, the sensors may be disposed on the door hanger and the plurality of openings can be formed within the header bracket.

The sensors in the best mode embodiment are inductive proximity sensors manufactured by Pepperl +Fuchs® Inc. of Twinsburg, Ohio. However, other types of sensors can be also used, such as capacitive or phototype sensors.

While the present invention has been illustrated and described with respect to a particular embodiment thereof, it should be appreciated by those of ordinary skill in the art, that various modifications to this invention may be made without departing from the spirit and scope of the present invention. For example, the secondary positioning system of the present invention may operate with different types of primary positioning systems. Furthermore, for some applications, the secondary positioning system of the present invention can be used as a sole positioning system. Additionally, the secondary positioning system of the present invention can be implemented on any type of an elevator car door system, including one driven by other types of motors. Also, the secondary positioning system of the present invention can operate with any type of elevator car door configuration, including a single slide elevator car door.

We claim:

1. A positioning system for an elevator car door of an elevator car in an elevator system comprising:

a first sensor, a second sensor and a third sensor disposed on said elevator car, said sensors being spaced apart from each other, each of said sensors sending a signal;

a door hanger for suspending said elevator car door therefrom, said door hanger having a plurality of openings facing said plurality of sensors, each of said plurality of openings has a first vertical edge and a second vertical edge with the distance from each said first vertical edge of one opening of said plurality of openings to said first vertical edge of an adjacent opening of said plurality of openings is equal approximately one full phase or 360°, each of said plurality of openings extends approximately half a phase or 180°, said first sensor and said second sensor are spaced approximately 120° apart, said second sensor and said third sensor are spaced approximately 120° apart; and means for interpreting said signals to determine a fully closed, fully opened and intermediate position and direction of said elevator car door.

2. The positioning system according to claim 1 wherein said first sensor, said second sensor and said third sensor are mounted within a sensor housing to protrude therefrom, said sensor housing being fixedly attached onto a header bracket, said header bracket being attached to said elevator car.

3. The positioning system according to claim 1 wherein said first sensor, said second sensor and said third sensor establish a fully opened and fully closed positions of said elevator car door, said first sensor and said second sensor establish an intermediate position and direction of said elevator car doors.

4. A positioning system for an elevator car door of an elevator car in an elevator system comprising:

a first sensor, a second sensor and a third sensor disposed on said elevator car, said sensors being spaced apart from each other, each of said sensors sending a signal;

a door hanger for suspending said elevator car door therefrom, said door hanger having a plurality of openings facing said plurality of sensors, said door hanger has a first vertical edge and a second vertical edge; a fully closed door region is defined between said first vertical edge and a first opening of said plurality of openings; a fully opened door region is defined between a last opening of said plurality of openings and said second vertical edge, said fully opened door region having a notch; and means for interpreting said signals to determine a fully closed, fully opened and intermediate position and direction of said elevator car door.

5. The positioning system according to claim 4 wherein said fully closed door region and said fully opened door region extend the length to fit said first, second and third sensor thereacross.

6. The positioning system according to claim 5 wherein said plurality of sensors detecting said door hanger intermittently with each of said plurality of openings and said notch, said plurality of sensors sending said signals having a high state when said door hanger being detected and a low state when one of said plurality of openings or said notch being detected.

7. The positioning system according to claim 6 wherein said first, second, and third sensors are spaced so that when said elevator car door is in a fully closed position all said sensors have said high state, when said elevator car is in a fully opened position all said sensors have low state, when said elevator car door is in intermediate position said signals from said first and second sensors determine intermediate position and direction of said elevator car door.

8. An elevator car door operating system for opening and closing an elevator car door in an elevator system, said elevator car door operating system characterized by:

a positioning system having a plurality of openings being formed within said elevator car door, said positioning system having a first sensor, a second sensor and a third sensor facing said plurality of openings, said first, second and third sensors being spaced apart from each other and being secured to said elevator car, each of said plurality of openings being spaced apart so that as said door is opening and closing, said first sensor, said second sensor and said third sensor establish a fully opened, fully closed and an intermediate position and direction of said elevator car doors.

9. A positioning system for an elevator car door of an elevator car in an elevator system comprising:

a first sensor disposed on said elevator car door and having a first signal;

a second sensor spaced apart from said first sensor and having a second signal;

a third sensor spaced apart from said second sensor and having a third signal;

a header bracket secured to said elevator car, said header bracket having a plurality of openings facing said plurality of sensors; and a controller including instructions for analyzing said first signal and said second signal for determining intermediate position and direction of said elevator car door and for analyzing said first signal, said second signal, and said third signal for determining a fully closed and a fully opened positions of said elevator car door.

10. The positioning system for an elevator car door according to claim 9 wherein said first, second, and third sensors and said plurality of openings are spaced such that when said first, second, and third sensors detect said header bracket said elevator car door is in a fully closed position, when said first, second, and third sensors detect openings said elevator car door is in a fully opened position, otherwise said signal from said first and second sensors determine intermediate position and direction of said elevator car doors.

* * * * *